US005248067A

United States Patent [19]

Garcia

[11] Patent Number: 5,248,067

[45] Date of Patent: Sep. 28, 1993

[54] MOUTHWASH DISPENSER KIT APPARATUS

[76] Inventor: Juan C. Garcia, 4858 Milwee, Houston, Tex. 77092

[21] Appl. No.: 874,522

[22] Filed: Apr. 27, 1992

[51] Int. Cl.[5] ..... B67D 3/00

[52] U.S. Cl. ..... 222/181; 222/185; 222/511; 222/561

[58] Field of Search ..... 222/181, 183, 185, 325, 222/511, 561, 93; 248/223.4, 224.3, 224.4

[56] References Cited

U.S. PATENT DOCUMENTS

| | | | |
|---|---|---|---|
| 1,938,181 | 12/1933 | Holmes | 222/181 |
| 2,610,014 | 9/1952 | Ananson | 248/223.4 |
| 2,781,152 | 2/1957 | Van Slyke | 222/181 X |
| 2,965,267 | 12/1960 | Darr | 222/181 X |
| 3,952,918 | 4/1976 | Poitras et al. | 222/181 X |
| 4,257,538 | 3/1981 | Fowler | 222/181 |

*Primary Examiner*—Sherman Basinger
*Attorney, Agent, or Firm*—Leon Gilden

[57] ABSTRACT

A wall plate is arranged for selective reception of a support member having a floor, with an internally threaded cylindrical skirt arranged to receive a mouthwash dispensing fluid container therewithin, with a valve plate reciprocatably mounted relative to a bottom surface of the floor to permit selective fluid flow therethrough. The apparatus is further arranged to include an adapter head arranged to receive a mouthwash bottle thereon having a truncated, conical directional conduit to receive an outlet opening of a fluid bottle.

3 Claims, 4 Drawing Sheets

MOUTHWASH DISPENSER KIT APPARATUS

BACKGROUND OF THE INVENTION

1. Field of the Invention

The field of invention relates to fluid dispenser apparatus, and more particularly pertains to a new and improved mouthwash dispenser kit apparatus wherein the same is arranged to accommodate mouthwash fluid for selective dispensing.

2. Description of the Prior Art

Various fluid dispensing apparatus is available in the prior art and set forth in U.S. Pat. No. 4,660,746 to Wright wherein a liquid closure cap is arranged for mounting to an upper end of a fluid container.

U.S. Pat. No. 3,734,106 to Zimmerman sets forth a toothbrush mouthwash rinser kit arranged to secure a toothbrush and liquid cap structure mounted to a handle portion of the toothbrush member.

U.S. Pat. No. 4,903,848 to Chattman sets forth a mouthwash packaging structure having a cap mounting a toothbrush thereto.

As such, it may be appreciated that there continues to be a need for a new and improved mouthwash dispenser kit apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of mouthwash dispensing apparatus now present in the prior art, the present invention provides a mouthwash dispenser kit apparatus wherein the same is arranged to selectively direct mouthwash fluid therefrom. As such, the general purpose of the present invention, which will be described subsequently in greater detail, is to provide a new and improved mouthwash dispenser kit apparatus which has all the advantages of the prior art mouthwash dispensing apparatus and none of the disadvantages.

To attain this, the present invention provides a wall plate arranged for selective reception of a support member having a floor, with an internally threaded cylindrical skirt arranged to receive a mouthwash dispensing fluid container therewithin, with a valve plate reciprocatably mounted relative to a bottom surface of the floor to permit selective fluid flow therethrough. The apparatus is further arranged to include an adapter head arranged to receive a mouthwash bottle thereon having a truncated, conical directional conduit to receive an outlet opening of the fluid bottle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mouthwash dispenser kit apparatus which has all the advantages of the prior art mouthwash dispensing apparatus and none of the disadvantages.

It is another object of the present invention to provide a new and improved mouthwash dispenser kit apparatus which may be easily and efficiently manufactured and marketed.

It is a further object of the present invention to provide a new and improved mouthwash dispenser kit apparatus which is of a durable and reliable construction.

An even further object of the present invention is to provide a new and improved mouthwash dispenser kit apparatus which is susceptible of a low cost of manufacture with regard to both materials and labor, and which accordingly is then susceptible of low prices of sale to the consuming public, thereby making such mouthwash dispenser kit apparatus economically available to the buying public.

Still yet another object of the present invention is to provide a new and improved mouthwash dispenser kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
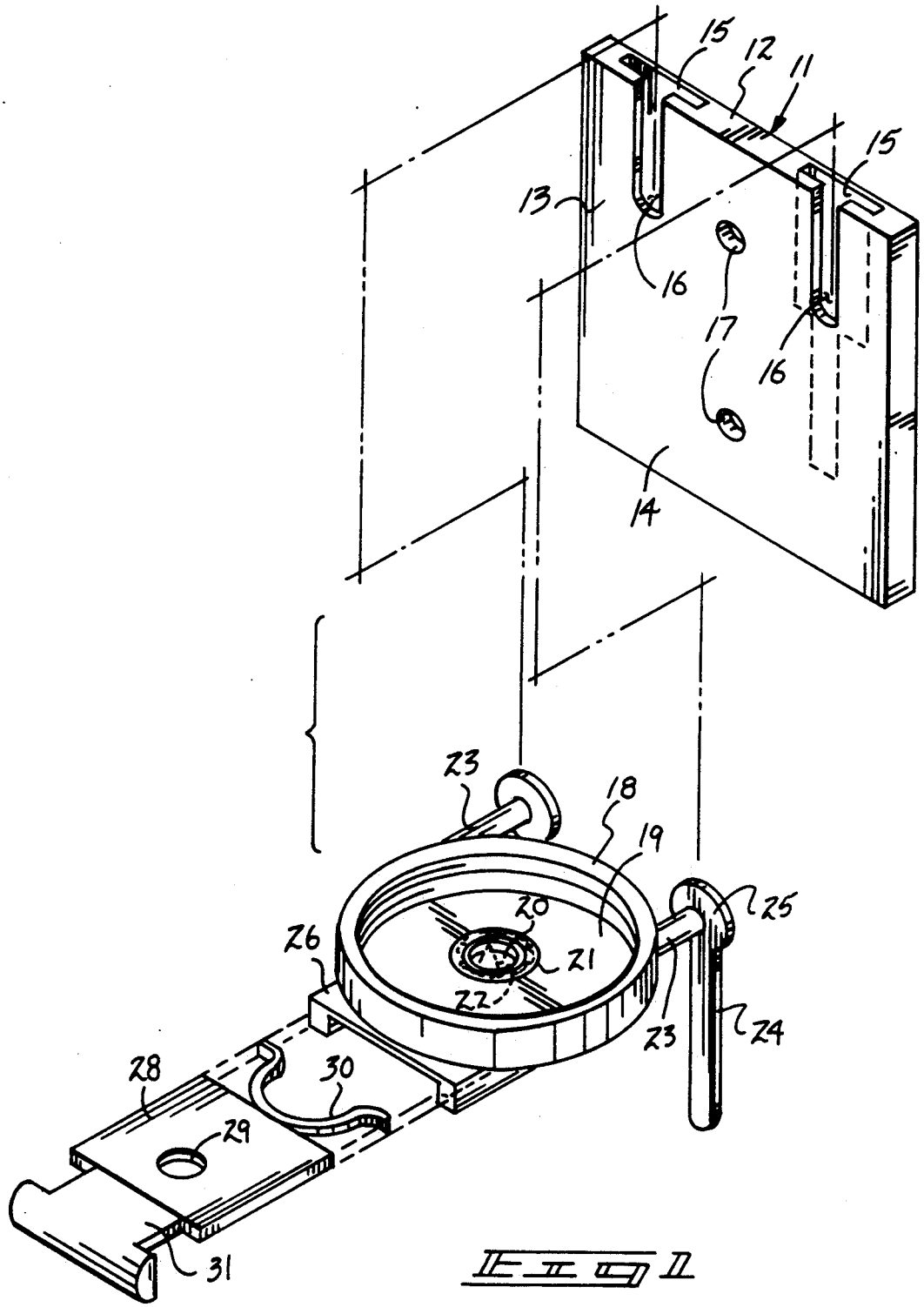
FIG. 1 is an illustration of the wall support structure of the invention.

With reference now to the drawings, and in particular to FIGS. 1 to 5 thereof, a new and improved mouthwash dispenser kit apparatus embodying the principles and concepts of the present invention and generally designated by the reference numerals 11 through 47 will be described.

More specifically, the mouthwash dispenser kit apparatus of the instant invention essentially comprises a wall plate 11 having a top surface 12 orthogonally oriented relative to a front surface 13, with a rear surface 14 arranged for contiguous mounting to a support wall (not shown) employing mounting apertures 17 to receive fasteners therethrough for direction into the wall. The top surface 12 includes a plurality of T-shaped slots 15 directed into the wall plate originating through the top surface 12, with a front wall slot opening 16 in communication with an upper portion of the T-shaped slot and a lower portion of each T-shaped slot arranged for receiving a locking plate of a first width substantially equal to the first widths of each lower portion of each T-shaped slot. The upper portion of each T-shaped slot is arranged to receive a locking plate head 25. A plurality of such locking plate heads 25 are provided, as illustrated in FIG. 1, in association with a plurality of locking plates 24. The locking plate heads 25 are defined by a second width greater than the first width to be received within an upper portion of the T-shaped slot, with each front wall slot opening 16 arranged for receiving a support leg 23 orthogonally and medially bisecting each respective locking plate head 25. A cylindrical internally threaded mounting skirt 18 includes a support floor 19 having a floor opening 20 directed coaxially therethrough coaxially aligned with the cylindrical mounting skirt 18. An annular seal 21 is arranged in surrounding relationship relative to the floor opening 20 and may optionally include a piercing blade 22 arranged for projecting through a typical foil seal of an associated commercially available container. The support legs 23 are integrally mounted to an exterior surface of the mounting skirt 18 orthogonally oriented relative to its axis. A support plate 26 is positioned below the floor 19 having confronting support ledges 27 on opposed sides of the support plate 26 slidingly receiving a valve plate 28 therebetween. The valve plate 28 has a valve plate bore 29 arranged for selective alignment with the floor opening 20, whereupon the valve plate 28 is biased by a valve plate spring 30 into a displaced position to displace the valve plate bore 29 relative to the floor opening 20, whereupon manual depressing of the valve plate 28 permits alignment of the valve plate bore relative to the floor opening 20 permitting fluid flow therethrough. A valve plate handle 31 projecting exteriorly of the support plate 26 is arranged for convenient manual grasping for displacement of the valve plate as noted above.

Figure 3:
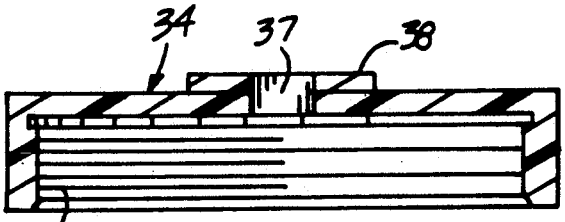
FIG. 3 is an orthographic view, taken along the lines 3—3 of FIG. 2 in the direction indicated by the arrows.
Figure 2:
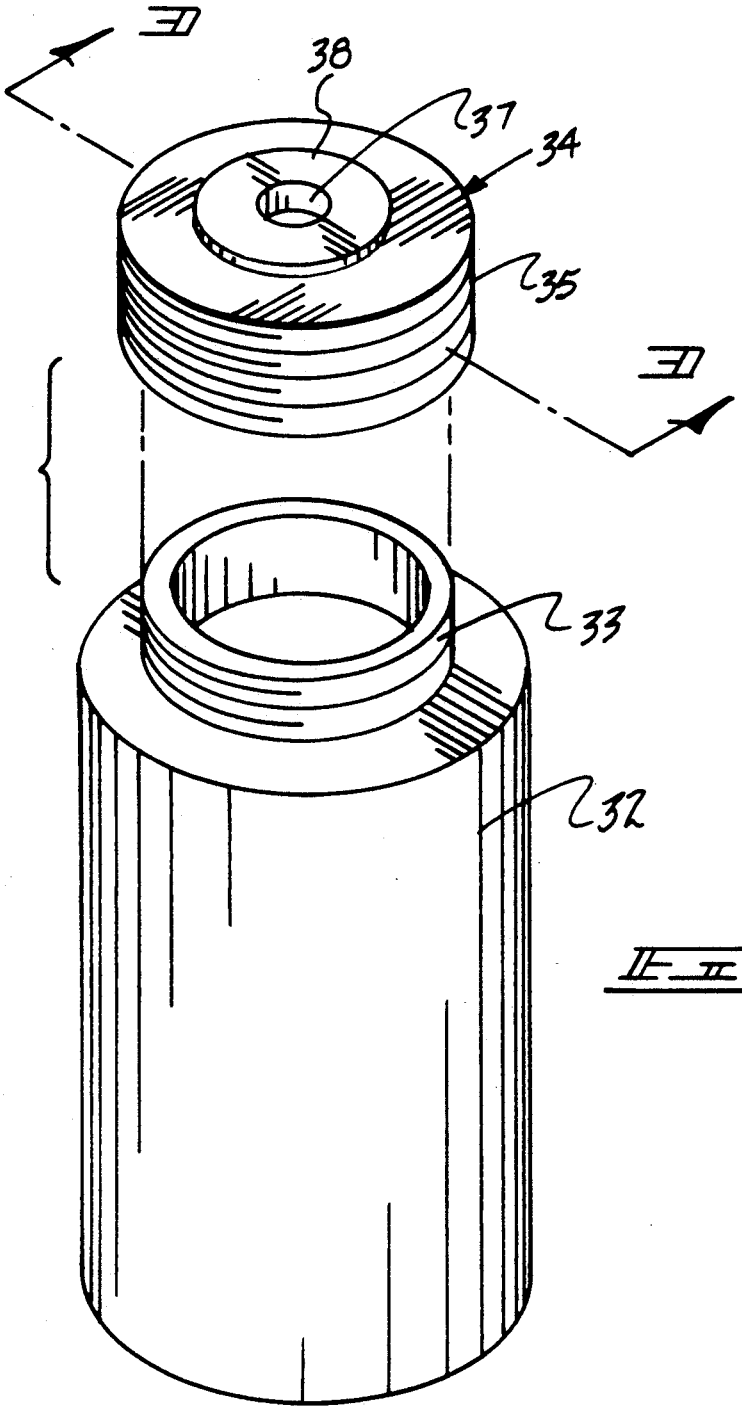
FIG. 2 is an isometric illustration of the mouthwash dispenser bottle of the invention.

The FIGS. 2 and 3 illustrate the use of a fluid container 32 utilized by the invention having a fluid container externally threaded outlet opening 33 for reception within an outlet opening head 34. The outlet opening head 34 has a head outer threaded portion 35 for threaded engagement within the internally threaded mounting skirt 18. Head inner threads 36 engage the fluid container's externally threaded outlet opening 33. A head central opening 37 directed medially of a top wall of the outlet opening head 34 includes a surrounding head central opening seal 38 for engagement with the annular seal 21 to permit fluid flow through the floor opening 20 only.

Figure 4:
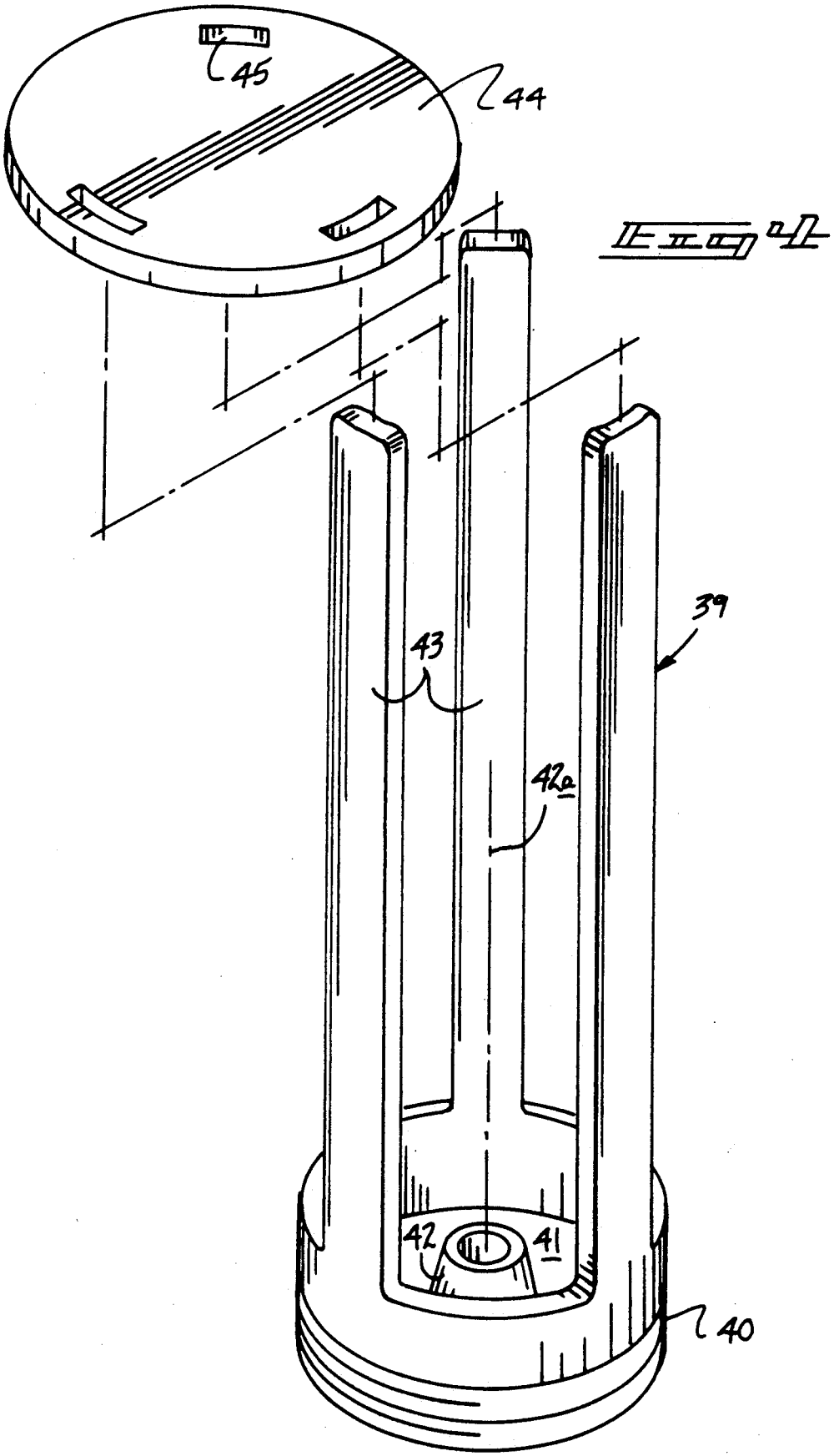
FIG. 4 is an isometric illustration of an adapter head structure for use by the invention.
Figure 5:
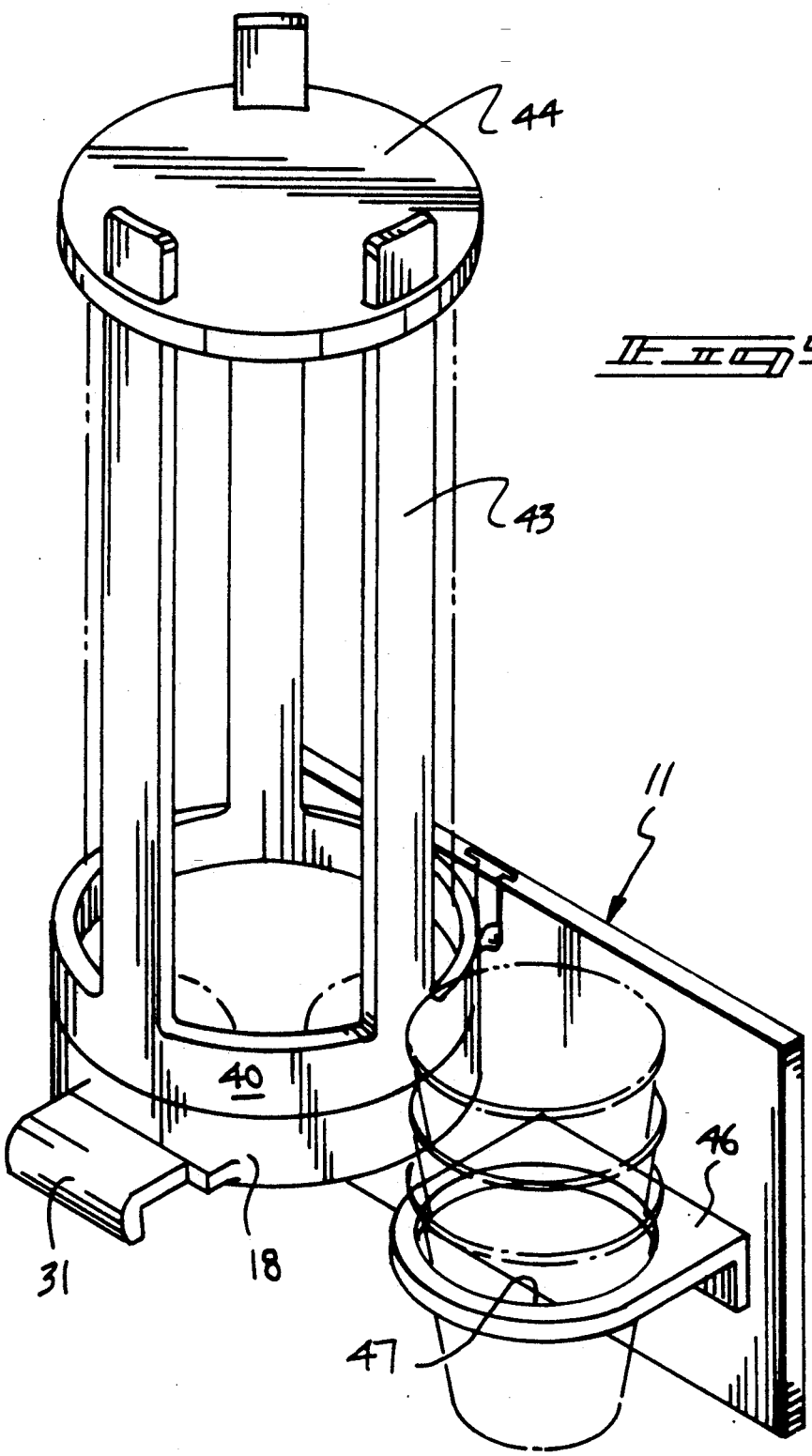
FIG. 5 is an isometric illustration of the adapter head mounted to the mounting skirt structure of the invention, as indicated in FIG. 1, in cooperation with a cup dispenser flange.

The FIG. 4 illustrates the use of a container adapter 39 employed by the invention as a portion of the kit structure to include a lower externally threaded cylindrical adapter head 40 arranged for selective reception within the mounting skirt 18. An adapter head floor 41 has a truncated conical receiving tube 42 coaxially aligned relative to the adapter head 40 projecting above the floor 41 within the adapter head formed of a resilient polymeric material to receive a fluid container opening thereabout in a sealing relationship (see FIG. 5). A plurality of support ribs 43 extend upwardly in a parallel relationship relative to the receiving tube axis 42*a* of the receiving tube 42, and a support rib plate 44 is provided having support rib slots 45 therethrough, with each slot arranged to receive an individual support rib 43 of the plurality of support ribs 43 to assist in alignment of the commercially available fluid container, as illustrated in FIG. 5. The use of the valve plate structure, as illustrated in FIG. 1, is employed by the organization, as illustrated in FIG. 5, and wherein the FIG. 5 structure further includes a cup holder flange 46 orthogonally mounted to the wall plate front surface 13 having a cup holder flange opening 47 directed therethrough to accommodate commercially available cup members in a convenient manner relative to the fluid dispensing structure for use by individuals.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mouthwash dispenser kit apparatus, comprising, a wall plate, the wall plate having a top surface, a front surface, and a rear surface, and the top surface including a plurality of T-shaped slots directed into the wall plate between the front surface and the rear surface originating at the top surface, each of the T-shaped slots include a front wall slot opening in communication with an upper portion of each T-shaped slot, and a lower portion of each T-shaped slot directed into the wall plate below the upper portion, with the upper portion directed from the lower portion to the top surface, and a cylindrical mounting skirt, the cylindrical mounting skirt including a plurality of support legs integrally mounted to an exterior surface of the mounting skirt, the support legs each including a locking plate, each locking plate arranged for projection into each T-shaped slot, and the mounting skirt having a support floor, the support floor including a floor opening coaxially aligned relative to the cylindrical mounting skirt, and an annular seal arranged in surrounding relationship relative to the floor opening, and a fluid container, the fluid container secured within a fluid container head, the head received within the mounting skirt, and the head includes head outer threads arranged for reception threadedly within the mounting skirt, and the head including head inner threads, the fluid container including a container outlet opening, the container outlet opening having outlet opening threads arranged for engagement within the head inner threads, and the outlet opening head including a top wall, with the top wall including a head central opening directed therethrough, the head central opening having a head seal arranged in surrounding relationship relative to the head opening for engagement with the annular seal, and a support plate mounted fixedly to the support floor below the mounting skirt, the support plate having confronting support ledges mounted to a bottom surface of the support plate, the support ledges slidably mounting a valve plate therealong, the valve plate having a valve plate bore displaced from the floor opening in a first position and aligned with the floor opening in a second position, with the valve plate having a valve plate spring mounted between the valve plate and a rear distal end of the support plate, and the valve plate including a valve plate handle projecting beyond the valve plate for manual grasping of the valve plate to displace the valve plate from the first position to the second position.

2. An apparatus as set forth in claim 1 wherein the locking plates include a locking plate head, the locking plate head is defined by a second width, each locking plate defined by a first width, and each support leg orthogonally and medially intersecting each one of said locking plate heads, with each locking plate head arranged for positioning within the T-shaped slot upper portion, and each support leg projecting through one of said front wall slot openings of each T-shaped slot.

3. An apparatus as set forth in claim 2 wherein the kit further includes a container adapter having a lower externally threaded cylindrical adapter head arranged for selective reception within the mounting skirt, and the adapter head having an adapter head floor, the adapter head floor including a truncated conical receiviung tube coaxially aligned relative to the cylindrical adapter head projecting above the adapter head floor, with the receiving tube arranged for projection within a container outlet opening, and a plurality of support ribs integrally mounted to the cylindrical adapter head projecting upwardly thereof, and the cylindrical adapter head defined about a tube axis coaxially aligned with the receiving tube, and the support ribs are arranged parallel to the tube axis, and a support rib plate having a plurality of slots therethrough, each slot arranged for receiving one of said support ribs therethrough in a sliding relationship to align the fluid container within the container adapter.

* * * * *